US005966981A

United States Patent [19]

Janos et al.

[11] Patent Number: 5,966,981

[45] Date of Patent: Oct. 19, 1999

[54] PRESS ASSEMBLY

[75] Inventors: Joseph J. Janos, West Salem; Henry J. Kelm, Litchfield, both of Ohio

[73] Assignee: Teledyne Industries, Inc., Cleveland, Ohio

[21] Appl. No.: 09/098,081

[22] Filed: Jun. 16, 1998

Related U.S. Application Data

[60] Provisional application No. 60/067,007, Dec. 1, 1997.

[51] Int. Cl.[6] ..... B21D 22/00

[52] U.S. Cl. ..... 72/350; 72/453.13; 72/19.9

[58] Field of Search ..... 72/350, 351, 453.13, 72/19.8, 19.9, 20.2, 21.4, 21.5; 267/119

[56] References Cited

U.S. PATENT DOCUMENTS

| | | | |
|---|---|---|---|
| 2,918,272 | 12/1959 | Williamson | 72/351 |
| 3,362,207 | 1/1968 | Perrone | 72/351 |
| 4,635,466 | 1/1987 | Seki et al. | 72/453.13 |
| 4,669,298 | 6/1987 | Kono et al. | 72/453.13 |
| 4,934,230 | 6/1990 | Wallis et al. | 83/128 |
| 5,003,807 | 4/1991 | Terrell et al. | 72/351 |
| 5,065,606 | 11/1991 | Kadis | 72/348 |
| 5,099,673 | 3/1992 | Baur | 72/351 |
| 5,687,598 | 11/1997 | Kirii et al. | 72/21.5 |

FOREIGN PATENT DOCUMENTS

| | | | |
|---|---|---|---|
| 3835470 | 6/1989 | Germany | 72/351 |

OTHER PUBLICATIONS

Article entitled "Advances and Trends in Sheet Metal Forming Processes",#970436, Klaus Siegert, University of Stuttgart, Copyright 1997 Society of Automotive Engineers, Inc., pp. 23 through 38.

Article entitled "Force–Stroke–Curve of Gas Springs", #970982, K. Siegert and J. Hohnhaus, University of Stuttgart, Copyright 1997 Society of Automotive Engineers, Inc., pp. 195 through 201.

Article entitled "The Die–Draulic Basic Unit", published prior to May 1, 1998.

*Primary Examiner*—Joseph J. Hail, III
*Assistant Examiner*—Ed Tolan
*Attorney, Agent, or Firm*—Tarolli, Sundheim, Covell, Tummino & Szabo

[57] ABSTRACT

A press assembly includes first and second members which engage opposite sides of a workpiece during operation of the press assembly. A cushion assembly is provided to absorb force transmitted from at least one of the members during operation of the press assembly. A high pressure reservoir is connected in fluid communication with a cylinder of the cushion assembly to receive fluid during operation of the press assembly. Hydraulic fluid is supplied to the cushion assembly at a relatively low pressure during operation of the press assembly. A valve is operable to block a flow of hydraulic fluid from the cushion assembly as the press assembly begins to operate from a closed condition toward an open condition to thereby retain the cushion assembly in a retracted condition. A secondary or pump cylinder may be actuated by operation of the press assembly to pump hydraulic fluid to the cushion assembly. A modulating valve is operable to modulate the fluid pressure conducted from the pump cylinder assembly to the cushion cylinder assembly during operation of the press assembly.

8 Claims, 4 Drawing Sheets

Fig.3
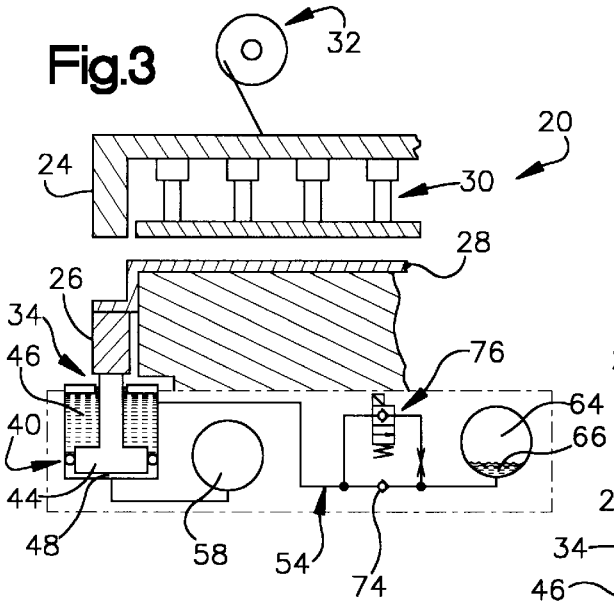
Fig.4
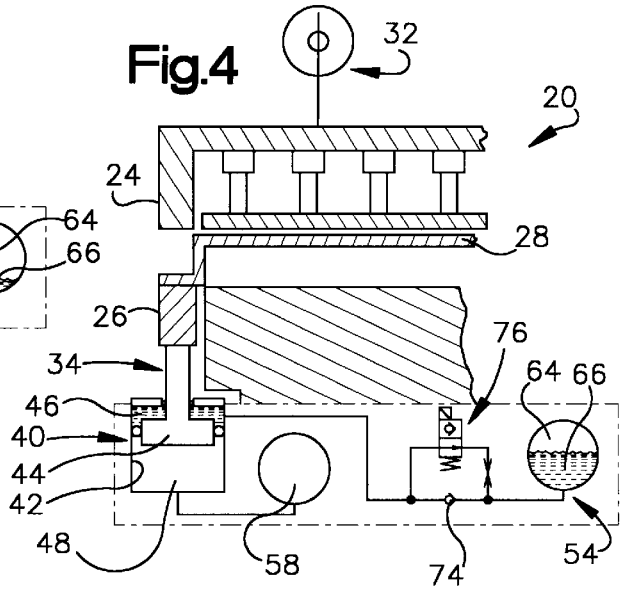
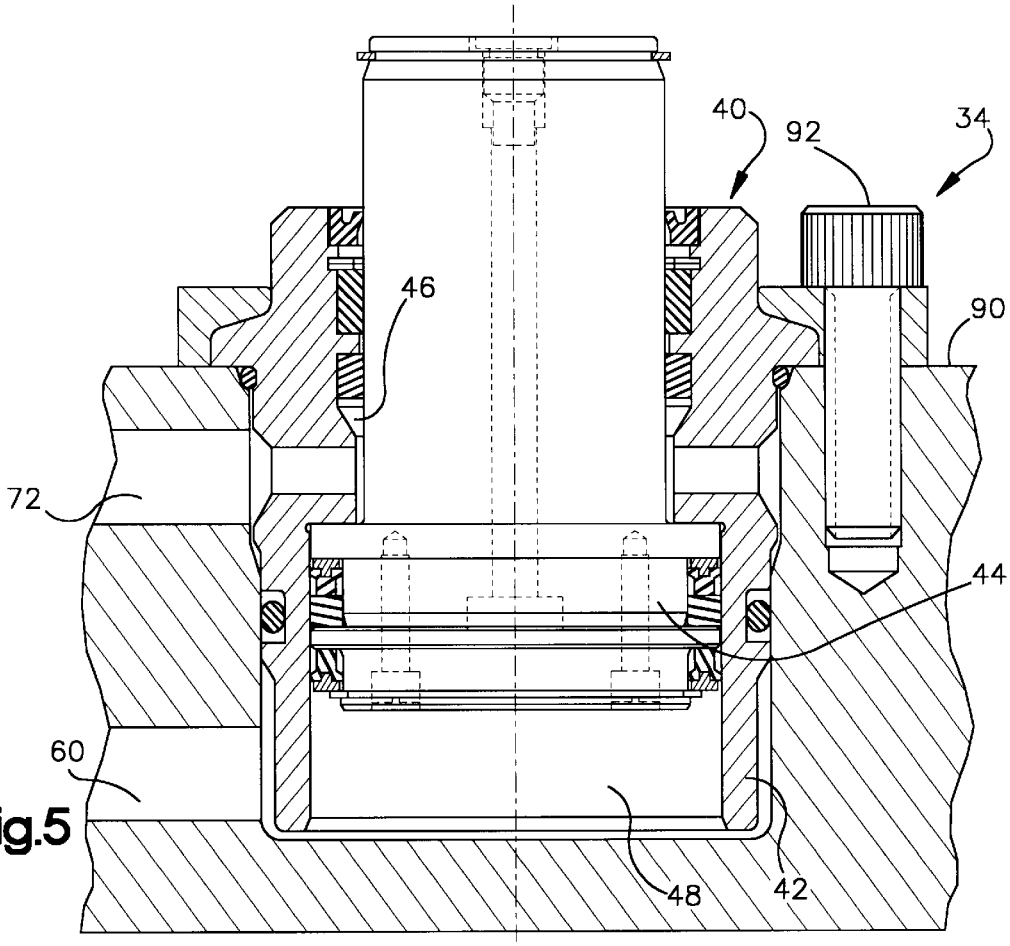
Fig.5

PRESS ASSEMBLY

This application claims the benefit of U.S. Provisional Application No. 60/067,007 filed Dec. 1, 1997. The benefit of the earlier filing date of the aforementioned Provisional Application Serial No. 60/067,007 under 35 U.S.C. 119(e) is claimed.

BACKGROUND OF THE INVENTION

The present invention relates to a press assembly and more specifically to an apparatus for controlling operation of a cushion assembly during operation of the press assembly.

During operation of a press assembly, it is desirable to control the manner in which a cushion assembly is operated. By controlling the operation of the cushion assembly, the rate of application of force to opposite sides of a workpiece can be controlled. In addition, shock loading of components of the press assembly can be minimized. Known methods of controlling the operation of a cushion assembly are disclosed in U.S. Pat. Nos. 5,003,807 and 5,065,606.

SUMMARY OF THE INVENTION

The present invention provides a new and improved press assembly having members which engage opposite sides of a workpiece during operation of the press assembly between an open condition and a closed condition. A cushion assembly is provided to absorb force transmitted from at least one of the members during operation of the press assembly. A high pressure reservoir may be connected in communication with the cushion assembly to receive fluid from the cushion assembly during operation of the press assembly from the open condition to the closed condition.

Fluid is supplied at a relatively low pressure to the cushion assembly during operation of the press assembly from an open condition to the closed condition. A control valve is provided to control the flow of fluid to and from the cushion assembly during operation of the press assembly. Thus, during operation of the press assembly from an open condition to a closed condition, the control valve may be utilized to modulate the flow of fluid to the cushion assembly to control the force absorbed by the cushion assembly. During operation of the press assembly from the closed condition to the open condition, the control valve may retard operation of the cushion assembly.

BRIEF DESCRIPTION OF THE DRAWINGS

The foregoing and other features of the present invention will become more apparent upon a consideration of the following description taken in connection with the accompanying drawings wherein:

FIG. 3 is a schematic illustration, generally similar to FIGS. 1 and 2, illustrating the manner in which operation of the cushion assembly is retarded during operation of the press assembly from the closed condition toward the open condition;

FIG. 4 is a schematic illustration, generally similar to FIGS. 1–3, illustrating the manner in which the cushion assembly is operated as the press assembly approaches an open condition;

FIG. 5 is a fragmentary sectional view of the cushion assembly used in the press assembly of FIGS. 1–4;

DESCRIPTION OF SPECIFIC PREFERRED EMBODIMENTS OF THE INVENTION

General Description

Figure 1:
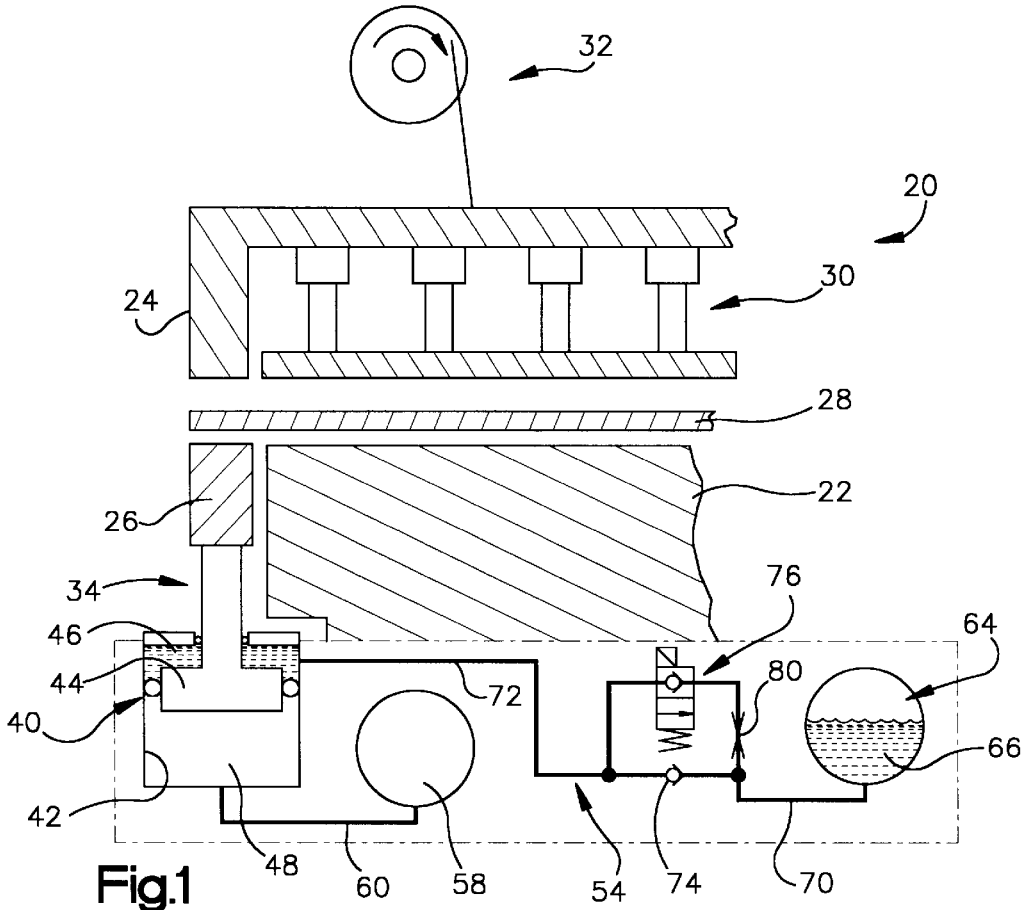
FIG. 1 is a schematic illustration of a press assembly having a cushion assembly with controls which are constructed and operated in accordance with the present invention, the press assembly being shown in an open condition.

An improved press assembly 20, which is constructed and operated in accordance with the present invention, is illustrated schematically in FIG. 1. The press assembly 20 includes a stationary base 22. An upper draw ring or member 24 cooperates with a movable lower draw ring or member 26 during operation of the press assembly to deform a sheet metal workpiece 28.

During operation of the press assembly 20, the upper and lower draw rings 24 and 26 are operable to apply pressure to opposite sides of the sheet metal workpiece 28 to firmly grip the workpiece between the draw rings. Once the workpiece has been gripped between the upper and lower draw rings 24 and 26, the upper and lower draw rings are lowered relative to a die (not shown) connected with the base 22. An upper cushion assembly 30 applies force against an upper side of the workpiece 28 in a known manner.

The upper and lower draw rings 24 and 26 have a generally rectangular configuration with an open central portion. The openings in the central portions of the upper and lower draw rings 24 and 26 have configurations corresponding to the configuration of the die around which the workpiece 28 is to be drawn. It should be understood that the upper and lower draw rings 24 and 26 have only been shown very schematically in the drawings and may have any desired configuration.

When the press assembly 20 is operated to stretch draw the sheet metal workpiece 28, a drive assembly 32 moves the upper drawing ring 24 downward toward the workpiece 28. As the downward motion of the upper draw ring 24 continues, the upper draw ring and workpiece 28 impact against the lower draw ring 26 to firmly grip the edges of the sheet metal workpiece. The upper and lower draw rings 24 and 26 are then lowered together to stretch the workpiece over the lower die and thereby deform the workpiece.

A cushion assembly 34 is mounted on the base 22. The cushion assembly 34 applies a yieldable force to the lower draw ring 26 to absorb energy during closing of the upper and lower draw rings 24 and 26 on the workpiece 28. The yieldable force applied to the lower draw ring 26 by the cushion assembly 34 opposes downward movement of the lower draw ring during operation of the press to a closed condition. Thus, the cushion assembly 34 cushions movement of components of the press assembly 20 during closing of the press assembly.

Although only a single cushion assembly 34 has been shown schematically in the drawings, it should be understood that the press assembly 20 includes a plurality of cushion assemblies. Although the cushion assembly 34 has been described here in association with the upper and lower draw rings 24 and 26, the cushion assembly could be associated with other members in a different type of press assembly if desired.

The cushion assembly 34 includes a piston and cylinder assembly 40. The piston and cylinder assembly 40 includes a cylinder 42 which is connected with the base 22. A piston 44 divides the cylinder 42 into upper and lower variable volume chambers 46 and 48. The upper variable volume chamber 46 contains hydraulic fluid. The lower variable volume chamber 48 contains gas, that is, nitrogen.

Cushion Assembly—Controls

In accordance with a feature of the present invention, cushion assembly controls 54 are provided to control operation of the cushion assembly 34 during operation of the press assembly 20 between the open and closed conditions. The cushion assembly controls 54 include a high pressure reservoir 58 which is connected in fluid communication with the lower variable volume chamber 48 in the cushion assembly 34 by a conduit 60.

Figure 2:
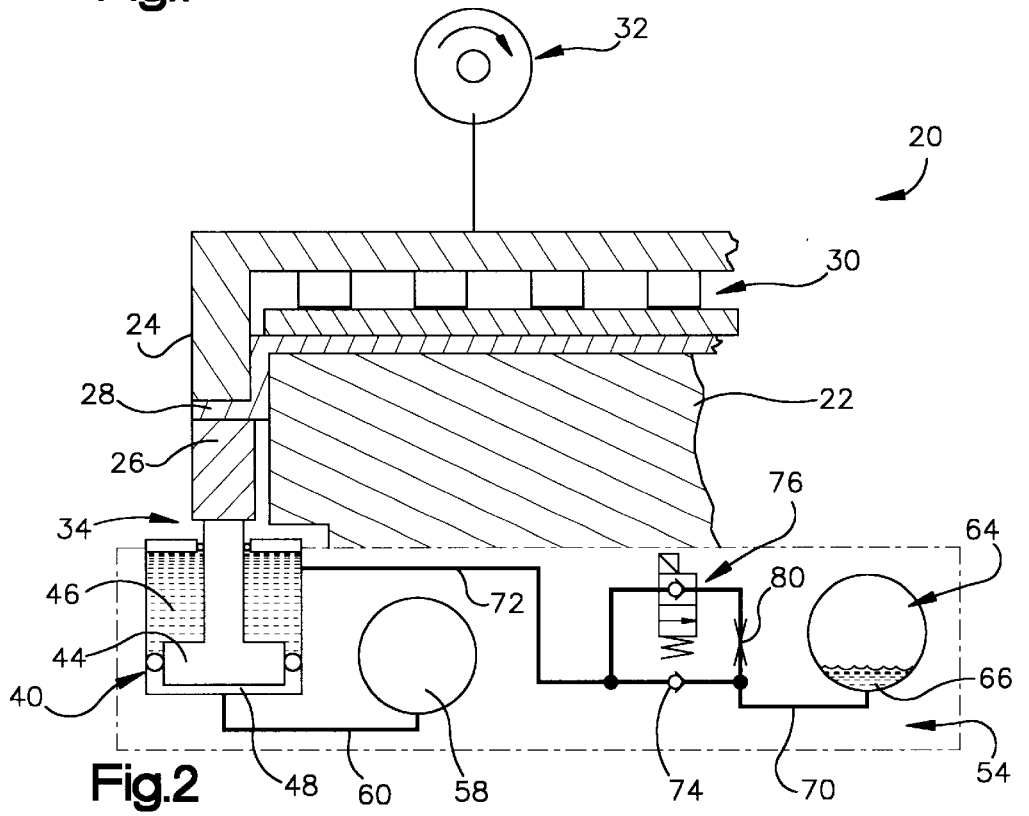
FIG. 2 is a schematic illustration, generally similar to FIG. 1, illustrating the press assembly in a closed condition.

During operation of the press assembly from the open condition illustrated in FIG. 1 to the closed condition illustrated in FIG. 2, high pressure gas (nitrogen) is conducted from the lower cylinder chamber 48 through the conduit 60 into the high pressure reservoir 58. Upon operation of the cushion assembly from the closed condition illustrated in FIG. 2 through the partially open condition illustrated in FIG. 3 to the open condition of FIG. 4, a flow of fluid (gas) is conducted from the high pressure reservoir 58 through the conduit 60 into the lower variable volume chamber 48 of the piston and cylinder assembly 40.

A low pressure reservoir or accumulator 64 holds hydraulic fluid 66 at a relatively low pressure which is applied against the hydraulic fluid by gas, that is nitrogen gas, in the upper portion of the low pressure reservoir 64. The low pressure reservoir 64 is connected with the upper variable volume chamber 46 in the piston and cylinder assembly 40 through conduits 70 and 72. A check valve 74 is provided to enable hydraulic fluid to be freely conducted from the low pressure reservoir 64 through the conduits 70 and 72 to the upper variable volume chamber 46. A control valve 76 is provided to control the flow of hydraulic fluid from the upper variable volume chamber 46 through the conduits 70 and 72 to the low pressure reservoir 64. The Control valve 76 is connected with the low pressure reservoir 64 through a variable orifice or flow restriction 80.

When a solenoid for controlling the valve 76 is energized, the valve is in the closed condition illustrated schematically in FIG. 1. When the valve 76 is in the closed condition, the valve blocks fluid flow from the upper variable volume chamber 46 in the cushion assembly 34 to the low pressure reservoir 64. Upon de-energization of the solenoid, the control valve 76 is operated from the closed condition illustrated in FIGS. 1-3 to the open condition of FIG. 4. Opening the control valve 76 enables fluid to flow from the upper variable volume chamber 46 through the control valve to the low pressure reservoir 64.

Operation

The improved cushion assembly controls 54 enable hydraulic fluid to flow from the low pressure reservoir 64 to the cushion assembly 34 as the press assembly 20 is operated from the open condition of FIG. 1 to the closed condition of FIG. 2. During a first or initial portion of the operation of the press assembly from the closed condition of FIG. 2 toward the open condition, that is to the partially open condition of FIG. 3, the cushion assembly controls 54 block a flow of hydraulic fluid from the cushion assembly 34 to the low pressure reservoir 64. Therefore, the cushion assembly 34 is maintained in a retracted condition by hydraulic fluid trapped in the upper variable volume chamber 46 of the cushion assembly.

During operation of the press assembly 20 from the partially open condition of FIG. 3 to the fully open condition of FIG. 4, the cushion assembly controls 54 enable hydraulic fluid to flow from the upper variable volume chamber 46 of the cushion assembly 34 to the low pressure reservoir 64. As this occurs, the cushion assembly 34 is operated from the retracted condition of FIGS. 2 and 3 to the extended condition of FIG. 4.

When the press assembly 20 is in the open condition of FIG. 1, the workpiece 28 is positioned in the press assembly. At this time, an edge portion of the workpiece 28 is disposed between the upper and lower draw rings 24 and 26. The lower draw ring 26 is supported adjacent to the workpiece by the extended cushion assembly 34.

As the press assembly 20 is operated from the open condition of FIG. 1 to the closed condition of FIG. 2, the drive assembly 32 moves the upper draw ring 24 downward to press the workpiece 28 against the lower draw ring 26. As this occurs, the upper cushion assembly 30 is retracted. In addition, the lower cushion assembly 34 is retracted.

As the lower cushion assembly 34 is retracted, high pressure nitrogen gas is forced from the lower variable volume chamber 42 of the cushion assembly 34 into the high pressure reservoir 58. This downward (as viewed in FIGS. 1 and 2) movement of the piston 44 occurs under the influence of force transmitted from the lower draw ring 26 to the piston. As the piston 44 moves downward and forces the high pressure nitrogen gas into the reservoir 58, forces transmitted from the upper and lower draw rings 24 and 26 are absorbed by the cushion assembly 34. This cushions operation of the press assembly 20 and minimizes shock loading on components of the press assembly as it is operated to the closed condition of FIG. 2.

As the cushion assembly 34 is operated from the extended condition of FIG. 1 to the retracted condition of FIG. 2, the upper variable volume chamber 46 expands. As the upper variable volume chamber 46 expands, hydraulic fluid is conducted at a relatively low pressure through the check valve 74 and control valve 76 to the upper variable volume chamber 46.

The hydraulic fluid in the upper variable volume chamber 46 of the cushion assembly 34 is at a pressure which is substantially less than the pressure of the gas (nitrogen) in the lower variable volume chamber 48. Therefore, the pressure of the low pressure hydraulic fluid in the upper variable volume chamber 46 does not substantially decrease the pressure differential across the piston 44 in the cushion assembly 34. This minimizes the extent to which the presence of the hydraulic fluid in the upper variable volume chamber 46 detracts from the ability of the cushion assembly 34 to absorb force during operation of the press assembly 20 from the open condition of FIG. 1 to the closed condition of FIG. 2.

During operation of the press assembly 20 from the closed condition of FIG. 2 to the partially open condition of FIG. 3, the control valve 76 is maintained in the closed condition illustrated in FIGS. 1–3. At this time, hydraulic fluid cannot flow from the upper variable chamber 46 of the cushion assembly 34 to the low pressure reservoir 64. This is because the control valve 76 and the check valve 74 block fluid flow from the cushion assembly 34 to the low pressure reservoir 64. The hydraulic fluid in the upper variable volume chamber 46 (FIG. 3) of the cushion assembly 34 blocks upward (as viewed in FIG. 3) movement of the piston 44. Therefore, the lower draw ring 26 is maintained in the retracted position shown in FIGS. 2 and 3 as the upper draw ring 24 moves away from the lower draw ring 26 (FIG. 3).

When the press assembly 20 has been operated to the partially open condition illustrated in FIG. 3, the control valve 76 is operated from the closed condition of FIG. 3 to the open condition of FIG. 4. Upon operation of the control valve 76 to the open condition of FIG. 4, hydraulic fluid can flow from the upper variable volume chamber 46 of the cushion assembly 34 to the low pressure reservoir 64. Therefore, the high pressure gas (nitrogen) in the lower variable volume chamber 48 can move the piston 44 upward (as viewed in FIG. 3) to effect operation of the cushion assembly from the retracted condition to the extended condition of FIG. 4. As this occurs, hydraulic fluid is pumped, by the piston 44, from the upper variable volume chamber 46 of the cushion assembly 34 back to the low pressure reservoir 64. Of course, this results in an increase in the volume of hydraulic fluid 66 in the low pressure reservoir 64.

Once the press assembly 20 has been operated to the fully open condition, the control valve, 76 is operated from the open condition of FIG. 4 back to the closed of FIG. 1. When this occurs, a flow of hydraulic fluid from the cushion assembly 34 to the low pressure reservoir 64 is again blocked. However, hydraulic fluid 66 can flow from the low pressure reservoir 64 back to the cushion assembly 34. While the press assembly 20 is in the fully open condition of FIG. 1, the formed workpiece is removed from the press assembly and a next succeeding workpiece is moved into the press assembly.

The construction of one specific preferred embodiment of the cushion assembly 34 is illustrated in FIG. 5. The cushion assembly 34 includes a cylinder 42 which is fixedly mounted on a block 90 by bolts 92. The piston 44 is disposed within the cylinder 42. The high press gas conduit 60 and the low pressure hydraulic fluid conduit 72 are formed in the block 90. Suitable seals are provided in association with the piston 44 to prevent the high pressure nitrogen gas from flowing from the lower variable volume chamber 48 around the piston 44 to the upper variable volume chamber 46.

Second Embodiment

In the embodiment of the invention illustrated in FIGS. 1–5, a low pressure reservoir 64 is utilized as a source of hydraulic fluid for the cushion assembly 46. In the embodiment of the invention illustrated in FIGS. 6–10, a secondary or pump piston and cylinder assembly is utilized as a source of hydraulic fluid. Since the embodiment of the invention illustrated in FIGS. 6–10 is generally similar to the embodiment of the invention illustrated in FIGS. 1–5, similar numerals will be utilized to designate similar components, the suffix letter "a" being utilized in association with the numerals of FIGS. 6–10 to avoid confusion.

A press assembly 20*a* includes a stationary base 22*a*. An upper draw ring or member 24*a* cooperates with a movable lower draw ring or member 26*a* during operation of the press assembly to deform a sheet metal workpiece 28*a*. During operation of the press assembly 20*a*, the upper and lower draw rings 24*a* and 26*a* are operable to apply pressure to opposite sides of the sheet metal workpiece 28*a* to firmly grip the workpiece between the draw rings. Once the workpiece 28*a* has been gripped between the upper and lower draw rings 24*a* and 26*a*, the draw rings are lowered to deform the workpiece around a die (not shown) in a stretch forming operation.

The upper and lower draw rings or members 24*a* and 26*a* have a generally rectangular configuration with an open central portion. The openings in the central portion of the upper and lower draw rings 24*a* and 26*a* have configurations corresponding to the configurations of the die around which the workpiece 28*a* is to be drawn. It should be understood that the upper and lower draw rings 24*a* and 26*a* have only been shown very schematically in the drawings and may have any desired configuration.

When the press assembly 20*a* is operated to stretch draw the sheet metal workpiece 28*a*, a drive assembly 32*a* moves the upper draw ring 24*a* downward toward the workpiece 28*a*. As the downward motion of the upper draw ring 24*a* continues, the upper draw ring and workpiece 28*a* impact against the lower draw ring 26*a* to firmly grip edges of the sheet metal workpiece. The upper and lower draw rings 24*a* and 26*a* are then lowered together to stretch the workpiece 28*a* over the lower die and thereby deform the workpiece.

A cushion assembly 34*a* is mounted on the base 22*a*. The cushion assembly 34*a* applies a yieldable force to the lower draw ring 26*a*. This yieldable force opposes downward movement of the lower draw ring 26*a* during operation of the press assembly to a closed condition. Thus, the cushion assembly 34*a* cushions movement of components of the press assembly 20*a* during the closing of the press assembly. Although only a single cushion assembly 34*a* has been shown schematically in the drawings, it should be understood that the press assembly 20*a* includes a plurality of cushion assemblies 34*a*.

The cushion assembly 34*a* includes a piston and cylinder assembly 40 *a* . The piston and cylinder assembly 40*a* includes a cylinder 42*a* which is connected with the base 22*a*. A piston 44*a* divides the cylinder 42*a* into upper and lower variable volume chambers 46*a* and 48*a*. The upper variable volume chamber 46*a* contains hydraulic fluid at a relatively low pressure. The lower variable volume chamber 48a contains gas (nitrogen) at a relatively high pressure.

In accordance with a feature of this embodiment of the invention, cushion assembly controls 54a are provided to control the operation of the cushion assembly 34a. The cushion assembly controls 54a include a high pressure reservoir 58a. The high pressure reservoir 58a is connected with the lower variable volume chamber 48*a* in the cushion assembly 34*a* by a conduit 60a.

A secondary or pump cylinder assembly 102 is mounted on the base 22*a* along with the cushion assembly 34*a*. The secondary or pump cylinder assembly 102 is operable under the influence of force transmitted through a projection 104 connected with the upper draw ring 24*a*. Thus, upon operation of the press assembly 20*a* from the open condition illustrated in FIG. 6 to the closed condition illustrated in FIG. 7, the projection 104 applies force against the pump cylinder assembly 102 to operate the pump cylinder assembly from the extended condition of FIG. 6 to the retracted condition of FIG. 7.

The pump cylinder assembly 102 includes a cylinder 105 which is connected with the base 22*a*. A piston 106 divides the cylinder 105 into an upper variable volume chamber 108 and a lower variable volume chamber 110. The upper variable volume chamber 108 is vented to the atmosphere and the lower variable volume chamber 110 contains hydraulic fluid. Although the specific preferred pump cylinder assembly 102 is of the piston and cylinder type, a different type of pump assembly could be used if desired. If desired, the pump assembly 102 could be actuated by a separate source of power, such as a motor, rather than the press assembly 20*a*.

Hydraulic fluid is supplied to the pump cylinder assembly 102 from a low pressure reservoir 64*a*. The low pressure reservoir 64*a* holds hydraulic fluid 66*a* which is maintained at a relatively low pressure by gas (nitrogen) disposed above the hydraulic fluid.

A modulating control valve 116 is provided to control the flow of hydraulic fluid from the cushion assembly 34*a* and from the pump assembly 102 to the low pressure reservoir 64*a*. A check valve 74*a* is effective to block the flow of hydraulic fluid from the cushion assembly 34*a* to the pump assembly 102. Therefore, all of the hydraulic fluid discharged from the cushion assembly 34*a* is conducted through the modulating control valve 116 to the low pressure reservoir 64*a*.

A second check valve 120 blocks fluid flow from the pump cylinder assembly 102 to the low pressure reservoir 64*a*. A restricted variable orifice 122 and a pressure relief valve 124 are provided to eliminate excess pressure in the pump cylinder assembly 102. Although a pressure relief valve 124 has been utilized in the specific embodiment of the invention illustrated in FIGS. 6 and 7, a different pressure relief device could be utilized if desired. A variable orifice 128 controls the maximum rate at which fluid can be discharged from the cushion assembly 34*a* to the low pressure reservoir 64*a*.

Second Embodiment—Operation

Figure 6:
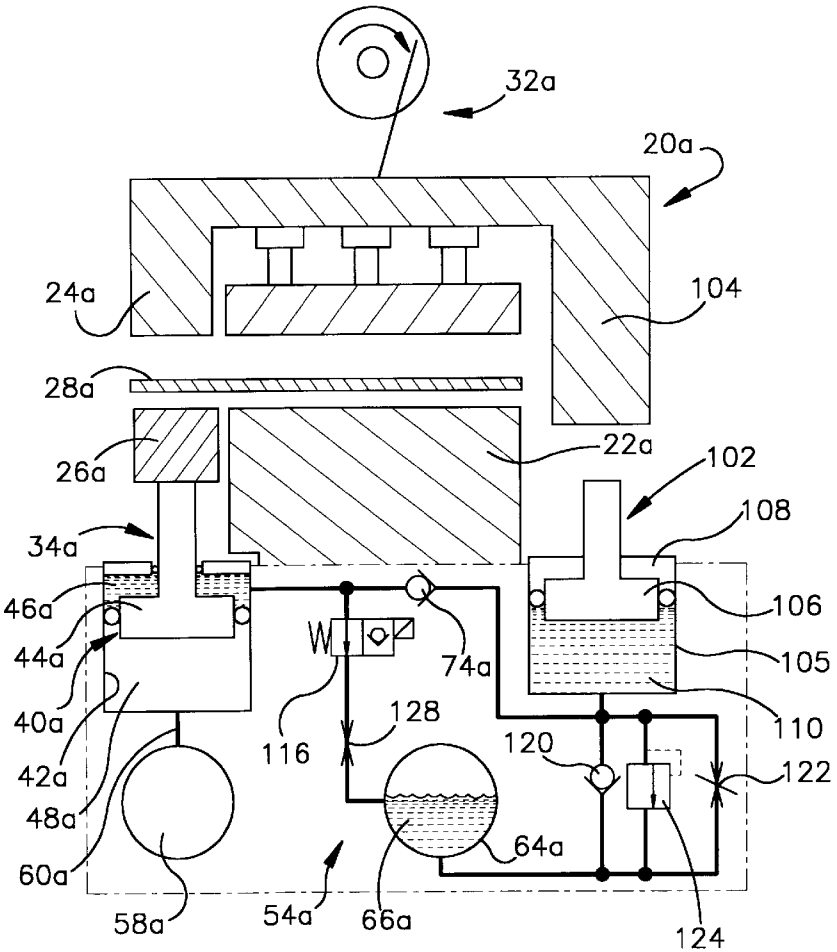
FIG. 6 is schematic illustration of a press assembly having a second embodiment of the cushion assembly controls, the press assembly being illustrated in an open condition.

When the press assembly 20*a* is in the open condition of FIG. 6, the upper draw ring 24*a* is spaced from the lower draw ring 26*a*. The lower draw ring 26*a* is supported by the extended cushion assembly 34*a*. At this time, the projection 104 extends downward from the upper draw ring 24*a* and is spaced from the pump cylinder assembly 102.

The piston 44*a* in the cushion assembly 34*a* is maintained in the raised or extended position by the relatively high fluid pressure conducted from the high pressure reservoir 58*a* through the conduit 60*a* to the lower variable volume chamber 48*a*. Similarly, the piston 106 in the pump cylinder assembly 102 is maintained in the raised or extended position shown in FIG. 6 by hydraulic fluid pressure conducted from the low pressure reservoir 64*a* through the check valve 120 to the lower variable volume chamber 110. At this time, the modulating valve 116 is in the open position illustrated in FIGS. 6 and 7.

Figure 7:
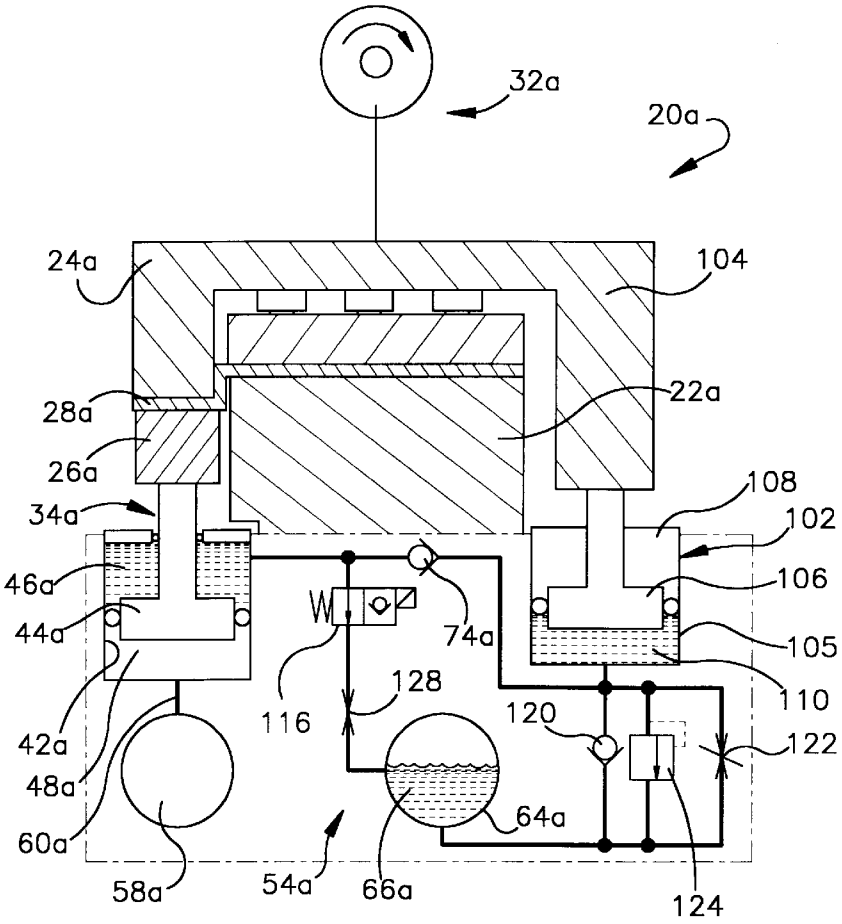
FIG. 7 is a schematic illustration, generally similar to FIG. 6, illustrating the press assembly in a closed condition.

As the press assembly 20*a* operates from the open condition shown in FIG. 6 toward the closed condition shown in FIG. 7, the projection 104 moves into engagement with the pump cylinder assembly 102. At the same time, the lower draw ring 26*a* is pressed downward against the cushion assembly 34*a*.

Operation of the pump cylinder assembly 102 forces hydraulic fluid from the lower variable volume chamber 110 through the check valve 74*a* to the upper variable volume chamber 46*a* of the cushion assembly 34*a*. The check valve 120 blocks fluid flow from the pump cylinder assembly 102 back to the low pressure reservoir 64*a*.

In accordance with a feature of the present invention, the modulating valve 116 is operated to modulate the fluid pressure conducted to the cushion assembly 34*a* from the pump cylinder assembly 102. By modulating the fluid pressure conducted from the pump assembly 102 to the cushion assembly 34*a*, the force with which the edge portion of the workpiece 20*a* is gripped between the upper draw ring 24*a* and lower draw ring 26*a* can be controlled. Controlling the force between the upper and lower draw rings 24*a* and 26*a* enables a deep drawn or complicated workpiece to be formed by the press 20*a*.

Although the modulating valve 116 could be operated to a partially open condition in which a minimum predetermined pressure is maintained in the upper variable volume chamber 46*a* of the cushion assembly 34*a*, it is contemplated that a microprocessor or an electronic controller may be connected with the modulating valve 116 to cause the modulating valve to either be actuated through relatively small increments or to dither. Although a specific modulating valve 116 has been illustrated in FIGS. 6 and 7, the modulating valve 116 could have any desired construction. For example, the modulating valve 116 could be a servo valve, a proportional valve, or a digital valve. The modulating valve 116 may be operated with either a dithering action or an incremental action.

The modulating action of the valve 16 causes variations in the fluid pressure in the upper variable volume chamber 46*a* of the cushion assembly 34*a* during operation of the press assembly 20*a* from the open condition of FIG. 6 toward the closed condition of FIG. 7. By varying the fluid pressure in the upper variable volume chamber 46*a* in a predetermined manner, the force with which the edge portion of the workpiece 28*a* is gripped between the upper draw ring 24*a* and lower draw ring 26*a* can be varied as the press assembly 20*a* is operated from the open condition of FIG. 6 to the closed condition of FIG. 7. This enables relatively complicated workpieces and/or deep drawn workpieces to be formed during operation of the press assembly 20*a*.

It is contemplated that a pressure sensor (not shown) could be provided in association with the upper variable volume chamber 46*a* of the cushion assembly 34*a*. The input to the microprocessor from the pressure sensor would enable the microprocessor to control the position of the modulating valve 116 as a function of fluid pressure. This would enable the modulating valve 116 to vary the fluid pressure in the upper variable volume chamber 46*a* of the cushion assembly 34*a* in a desired manner as the press assembly 20*a* is operated from the open condition toward the closed condition.

As the press assembly 20*a* is operated from the open condition of FIG. 6 to the closed condition of FIG. 7, a volume of fluid is discharged from the pump cylinder assembly 102 which is greater than the increase in volume of the upper variable volume chamber 46*a* in the cushion assembly 34*a*. This results in a portion of the hydraulic fluid discharged from the pump cylinder assembly 102 being conducted through the modulating valve 116 to the low pressure reservoir 64*a*.

As hydraulic fluid is conducted to the expanding upper variable volume chamber 46*a* of the cushion assembly 34*a*, gas (nitrogen) is discharged from the contracting lower variable volume chamber 48*a* at a relatively high pressure to the high pressure reservoir 58*a*. By discharging gas from the lower variable volume chamber 48*a* of the cushion assembly 34*a* to the high pressure reservoir 58*a*, force transmitted from the upper draw ring 24*a* and lower draw ring 26*a* is absorbed by the cushion assembly 34*a* to cushion components of the press assembly 20*a*.

The fluid pressure in the high pressure reservoir 58*a* is substantially greater than the fluid pressure in the low pressure reservoir 64*a* and the pressure in the upper variable volume chamber 46*a* of the cushion assembly 34*a*. The fluid pressure in the upper variable volume chamber 46*a* of the cushion assembly 34*a* may vary during operation of the press assembly from the open condition of FIG. 6 to the closed condition of FIG. 7, due to the action of the modulating valve 116. However, there is a very large pressure differential between the upper variable volume chamber 46*a* and lower variable volume chamber 48*a* of the cushion assembly 34*a* to enable the cushion assembly to absorb a substantial amount of force as the press assembly 20*a* operates from the open condition to the closed condition.

Although the modulating valve 116 may be moved through relatively small increments during operation of the press assembly 20*a* from the open condition of FIG. 6 to the closed condition of FIG. 7, to vary or modulate the fluid pressure in the upper variable volume chamber 46*a* of the cushion assembly 34*a*, the modulating valve 116 is maintained in an open condition illustrated schematically in FIGS. 6 and 7 as the press assembly 20*a* is operated to the closed condition. Once the press assembly 20*a* is operated to the closed condition, the modulating valve 116 is operated from the open condition to the closed condition of FIG. 8.

Figure 8:
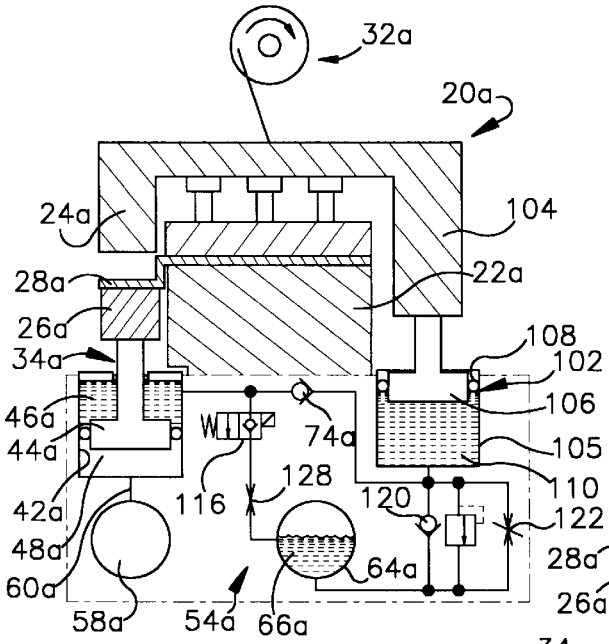
FIG. 8 is a schematic illustration of the manner in which operation of the cushion assembly is delayed during initial operation of the press assembly from the closed condition of FIG. 7 toward the open condition of FIG. 6.

Operation of the modulating valve 116 to the closed condition of FIG. 8 blocks a flow of hydraulic fluid from the upper variable volume chamber 46*a* of the cushion assembly 34*a*. Therefore, as the press assembly 20*a* is operated from the closed condition of FIG. 7 to the partially open condition of FIG. 8, hydraulic fluid is trapped or locked in the upper variable volume chamber 46*a* of the cushion assembly 34*a*. This results in the cushion assembly 34*a* being maintained in the retracted condition to which it was operated as the press assembly 20*a* operated from the open condition of FIG. 6 to the closed condition of FIG. 7.

As the press assembly 20*a* operates from the closed condition of FIG. 7 to the partially open condition of FIG. 8 with the modulating valve 116 closed, hydraulic fluid is conducted from the low pressure reservoir 64*a* through the check valve 120 to the pump cylinder assembly 102. As this occurs, the piston 106 is moved upward with the projection 104 and upper draw ring 24*a*. Since the reservoir 64*a* holds hydraulic fluid at a relatively low pressure, a relatively small amount of force is transmitted from the piston 106 to the upper draw ring 24*a* from the pump assembly 102.

Figure 9:
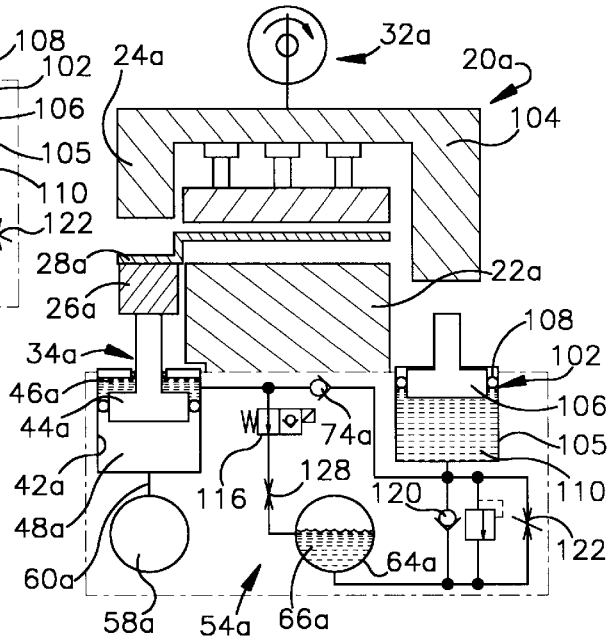
FIG. 9 is a schematic illustration, generally similar to FIGS. 6–8, illustrating the cushion assembly and associated controls as the press assembly approaches an open condition.

As the press assembly 20*a* is operated from the closed condition of FIG. 7 to the partially open condition of FIG. 8, the pump assembly 102 is operated from the retracted condition of FIG. 7 to the extended condition of FIG. 8. As this occurs, the cushion assembly 34*a* remains in the retracted condition of FIGS. 7 and 8. Once the press assembly 20*a* has been operated to the partially open condition of FIG. 8, the modulating valve 116 is operated from the closed condition (FIG. 8) to the open condition (FIG. 9). Operation of the modulating valve 116 to the open condition enables hydraulic fluid to flow from the upper variable volume chamber 46*a* of the cushion assembly 32*a* to the low pressure reservoir 64*a*. Therefore, the high pressure gas (nitrogen) in the lower variable volume chamber 48*a* of the cushion assembly 34*a* is effective to move the piston 44*a* upward from the retracted position of FIG. 8 to the extended position of FIG. 9. As this occurs, hydraulic fluid is forced from the upper variable volume chamber 46*a* of the cushion assembly 34*a* through the open modulating valve 116 to the low pressure reservoir 64*a* (FIG. 9). The check valve 74*a* blocks fluid flow from the cushion assembly 34*a* to the pump cylinder assembly 102.

As the cushion assembly 34*a* is operated from the retracted condition of FIG. 8 to the extended condition of FIG. 9 and the press assembly 20*a* is operated to the fully open condition, the lower draw ring 26*a* moves the workpiece upward. The finished workpiece 28*a* can then be moved from the press assembly 20*a* and a next succeeding workpiece moved into the press assembly.

Figure 10:
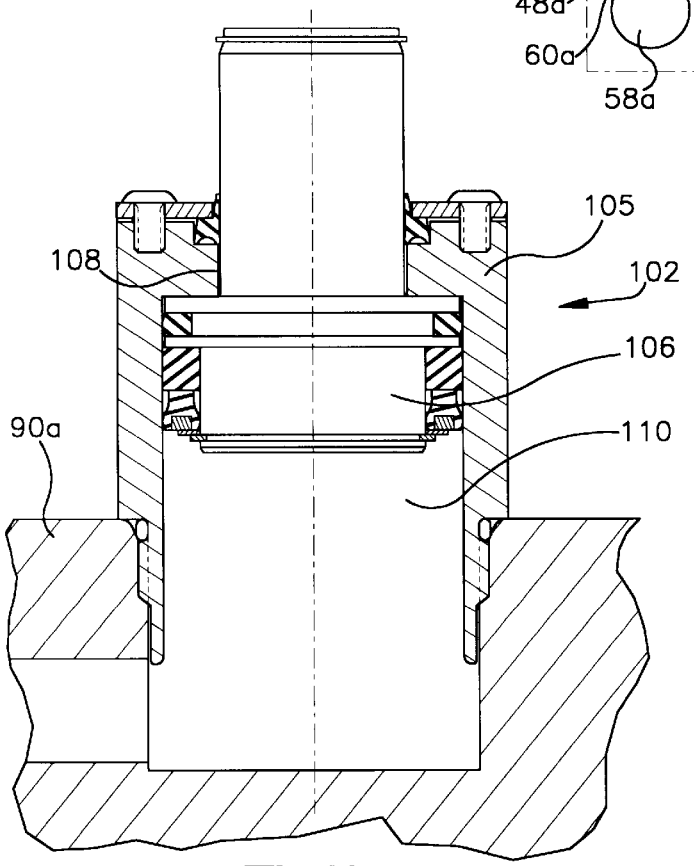
FIG. 10 is a fragmentary sectional view illustrating a pump cylinder assembly used with the cushion assembly of FIGS. 6–9.

The construction of one specific embodiment of the pump assembly 102 is illustrated in FIG. 10. The cylinder 110 of the pump assembly 102 is connected with a mounting block 90*a*. This may be the same mounting block in which the cushion assembly 34*a* is mounted or may be a separate mounting block depending upon the construction of the press assembly 20*a*. Suitable seals are associated with the piston 106 to prevent leakage of hydraulic fluid. The upper variable volume chamber 108 is vented to the atmosphere through a passage (not shown) formed in the cylinder 104.

Conclusion

The present invention provides a new and improved press assembly 20 having members 24 and 26 which engage opposite sides of a workpiece 28 during operation of the press assembly between an open condition and a closed condition. A cushion assembly 34 is provided to absorb force transmitted from at least one of the members 24 and 26 during operation of the press assembly 20 between the open and closed condition. A high pressure reservoir 58 may be connected in communication with the cushion assembly 34 to receive fluid from the cushion assembly at a relatively high pressure during operation of the press assembly 20 from the open condition to the closed condition.

Fluid is supplied at a relatively low pressure to the cushion assembly 34 during operation of the press assembly from an open condition to the closed condition. A control valve 76 or 116 is provided to control the flow of fluid to and from the cushion assembly 34 during operation of the press assembly. Thus, during operation of the press assembly 20 from an open condition to a closed condition, the control valve 116 may be utilized to modulate the flow of fluid to the cushion assembly 34 to control the force absorbed by the cushion assembly. During operation of the press assembly 20 from the closed condition to the open condition, the control valve 116 may retard operation of the cushion assembly.

Having described the invention, the following is claimed:

1. A press assembly operable from an open condition to a closed condition to deform a workpiece, said press assembly comprising first and second members for engaging opposite sides of the workpiece during operation of said press assembly between the open condition and the closed condition, a cushion assembly operable from an extended condition to a retracted condition to absorb force transmitted from at least one of said members during operation of said press assembly between the open and the closed conditions, a pump assembly connected in fluid communication with said cushion assembly and operable from an extended condition to a retracted condition to pump fluid to said cushion assembly during operation of said press assembly from the open condition to the closed condition, a fluid reservoir, and a modulating valve connected in fluid communication with said cushion assembly, said pump assembly and said fluid reservoir, said modulating valve being operable to modulate fluid flow from said pump assembly to said fluid reservoir and to said cushion assembly during operation of said press assembly from the open condition to the closed condition to modulate transmission of force between said one of said members and said cushion assembly during operation of said press assembly between the open and closed conditions, said modulating valve being operable to a closed condition to block fluid flow from said cushion assembly to said fluid reservoir to maintain said cushion assembly in the retracted condition of said cushion assembly during a first portion of operation of said press assembly from the closed condition to the open condition, said pump assembly being operable from the retracted condition of said pump assembly toward the extended condition of said pump assembly during the first portion of operation of said press assembly from the closed condition to the open condition while said cushion assembly is in the retracted condition of said cushion assembly, said fluid reservoir being effective to supply fluid to said pump assembly during operation of said pump assembly from the retracted condition of said pump assembly toward the extended condition of said pump assembly while said cushion assembly is in the retracted condition of said cushion assembly.

2. A press assembly as set forth in claim 1 wherein said modulating valve is operable from the closed condition to an open condition to enable fluid to flow from said cushion assembly to said fluid reservoir and to enable said cushion assembly to operate from the retracted condition of said cushion assembly while said pump assembly remains in the extended condition of said pump assembly during a second portion of operation of said press assembly form the closed condition to the open condition.

3. A press assembly as set forth in claim 1 further including a check valve connected in fluid communication with said pump assembly and said cushion assembly to block fluid flow from said cushion assembly to said pump assembly during operation of said pump assembly from the retracted condition of said pump assembly toward the extended condition of said pump assembly with said cushion assembly in the retracted condition of said cushion assembly.

4. A press assembly as set forth in claim 1 further including a check valve connected in fluid communication with said fluid reservoir and said pump assembly to block fluid flow from said pump assembly to reservoir along a fluid flow path which is spaced apart from said modulating valve during operation of said pump assembly from the extended condition of said pump assembly to the retracted condition of said pump assembly during operation of said press assembly from the open condition to the closed condition, said check valve being effective to enable fluid to flow from said reservoir to said pump assembly during operation of said pump assembly from the retracted condition of said pump assembly toward the extended condition of said pump assembly while said cushion assembly is in the retracted condition of said cushion assembly.

5. A press assembly as set forth in claim 1 wherein said cushion assembly holds a volume of fluid at a first pressure when said cushion assembly is in the retracted condition of said cushion assembly, said fluid reservoir supplies fluid to said pump assembly at a second pressure which is less than said first pressure to effect operation of said pump assembly from the retracted condition of said pump assembly toward the extended condition of said pump assembly.

6. A press assembly operable from an open condition to a closed condition to deform a workpiece, said press assembly comprising first and second members for engaging opposite sides of a workpiece during operation of said press assembly between an open condition and a closed condition, a cushion assembly operable from an extended condition to a retracted condition to absorb force transmitted from at least one of said members during operation of said press assembly from the open condition to the closed condition, said cushion assembly including a cylinder and a piston which divides said cylinder into first and second variable volume chambers, a high pressure fluid reservoir connected in fluid communication with said first variable volume chamber in said cushion assembly, said piston being movable against the influence of fluid pressure in said first variable chamber to contract said first variable volume chamber and expand said second variable volume chamber during operation of said press assembly from the open condition to the closed condition, said piston being movable under the influence of fluid pressure in said first variable volume chamber to contract said second variable volume chamber and expand said first variable volume chamber during operation of said press assembly from the closed condition to the open condition, a pump assembly connected in fluid communication with said second variable volume chamber in said cushion assembly through a cushion assembly supply conduit, said pump assembly being operable to discharge fluid to said cushion assembly supply conduit during operation of said press assembly from the open condition to the closed condition, a first check valve connected with said cushion assembly supply conduit to block fluid flow from said cushion assembly to said pump assembly through said cushion assembly supply conduit during operation of said press assembly from the closed condition to the open condition, a low pressure fluid reservoir connected in fluid communication with said second variable volume chamber in said cushion assembly, said low pressure fluid reservoir containing fluid at a pressure which is lower than a pressure at which fluid is contained in said high pressure fluid reservoir to enable fluid discharged from said second variable volume chamber in said cushion assembly during contraction of said second variable volume chamber in said cushion assembly to flow to said low pressure fluid reservoir, a control valve connected in fluid communication with said low pressure fluid reservoir and said second variable volume chamber in said cushion assembly, said control valve being operable to a closed condition to block fluid flow from said second variable volume chamber in said cushion assembly during a first portion of the operation of said press assembly from the closed condition to the open condition to maintain said cushion assembly in the retracted condition during the first portion of the operation of said press assembly from the closed condition to the open condition, said control valve being operable to an open condition to enable fluid to flow from said second variable volume chamber in said cushion assembly to said low pressure fluid reservoir during a second portion of the operation of said press assembly from the closed condition to the open condition to enable said cushion assembly to operate from the retracted condition to the extended condition during the second portion of the operation of said press assembly from the closed condition to the open condition, a pump assembly supply conduit connected in fluid communication with said low pressure fluid reservoir and said pump assembly, and a second check valve connected with said pump assembly supply conduit to enable fluid to flow from said low pressure fluid reservoir to said pump assembly and to block fluid flow from said pump assembly to said low pressure reservoir through said pump assembly supply conduit.

7. A press assembly as set forth in claim 6 wherein said control valve is operable to modulate fluid flow from said second variable volume chamber of said cushion assembly to said low pressure fluid reservoir during operation of said press assembly from the open condition to the closed condition to modulate transmission of force between said one of said members and said cushion assembly during operation of said press assembly between the open and closed conditions.

8. A press assembly as set forth in claim 6 wherein said pump assembly includes a cylinder and a piston which are relatively movable during operation of said press assembly from the open condition to the closed condition to discharge fluid at a pressure which is greater than a pressure of fluid in said low pressure fluid reservoir.

* * * * *